US007175792B1

(12) United States Patent
Bauer et al.

(10) Patent No.: US 7,175,792 B1
(45) Date of Patent: Feb. 13, 2007

(54) METHOD FOR PRODUCING CELLULOSE SHAPED-BODIES

(75) Inventors: Ralf-Uwe Bauer, Rudolstadt (DE); Uwe Kind, Rudolstadt (DE)

(73) Assignee: Zimmer AG, Frankfurt (DE)

( * ) Notice: Subject to any disclaimer, the term of this patent is extended or adjusted under 35 U.S.C. 154(b) by 615 days.

(21) Appl. No.: 10/088,751

(22) PCT Filed: Sep. 29, 2000

(86) PCT No.: PCT/DE00/03408

§ 371 (c)(1),
(2), (4) Date: Jul. 19, 2002

(87) PCT Pub. No.: WO01/25515

PCT Pub. Date: Apr. 12, 2001

(30) Foreign Application Priority Data

Oct. 7, 1999 (DE) ..... 199 48 401

(51) Int. Cl.
*D01F 2/02* (2006.01)
*D21C 9/10* (2006.01)

(52) U.S. Cl. ..... 264/187; 162/9; 162/182; 8/116.1

(58) Field of Classification Search ..... 264/187; 162/9, 182; 8/116.1
See application file for complete search history.

(56) References Cited

U.S. PATENT DOCUMENTS 4,480,089 A * 10/1984 Chen et al. ..... 536/56
6,409,881 B1 * 6/2002 Jaschinski ..... 162/9
6,524,348 B1 * 2/2003 Jewell et al. ..... 8/116.1
7,052,540 B2 * 5/2006 McCreight et al. .... 106/168.01
2002/0098317 A1 * 7/2002 Jaschinski et al. ..... 428/72
2003/0051834 A1 * 3/2003 Weerawarna et al. ..... 162/9

FOREIGN PATENT DOCUMENTS

EP 047929 * 9/1981
WO WO 97/23666 * 7/1997

OTHER PUBLICATIONS

Rogowin S.A.: "Chemiefasern", VEB Fachbuchverlag, Leipzig, 1960 XP-002161407, pp. 168-169.*

* cited by examiner

*Primary Examiner*—Mark A. Osele
(74) *Attorney, Agent, or Firm*—Steven J. Hultquist; Intellectual Property Technology Law

(57) ABSTRACT

Process for manufacture of cellulose mouldings, such as fibres, filaments, or films, from TCF-bleached or ECF-bleached cellulose, in which the bleached cellulose is dissolved in an aqueous tertiary aminoxide to form a mouldable cellulose, the cellulose solution deforms, and the moulding comes into being by coagulation of the deformed solution, characterized in that, to reduce the cellulose decomposition in the process, TCF-bleached cellulose is used comprising carboxyl group content in the range from 1 to 35 μmol/g or an ECF-bleached cellulose with carboxyl group content in the range from 1 to 50 μmol/g. Cellulose mouldings having a reduced cellulose decomposition may be formed by said process.

17 Claims, No Drawings

METHOD FOR PRODUCING CELLULOSE SHAPED-BODIES

CROSS-REFERENCE TO RELATED APPLICATIONS

This application is filed under the provisions of 35 U.S.C. §371 and claims the priority of International Patent Application No. PCT/DE00/03408 filed Sep. 29, 2000, which in turn claims priority of German Patent Application No. 199 48 401.5 filed Oct. 7, 1999.

FIELD OF THE INVENTION

The invention relates to a process for the manufacture of cellulose mouldings, such as fibres, filaments, or films, from TCF-bleached or ECF-bleached cellulose, in which the bleached cellulose is dissolved in an aqueous tertiary aminoxide to form a mouldable cellulose solution, the cellulose solution deforms, and the moulding comes into being by coagulation of the deformed solution. The invention also relates to the use of a TCF or ECF-bleached cellulose pulp for the manufacture of cellulose mouldings.

BACKGROUND OF THE INVENTION

The problems of the viscous process led to the development of new processes for the manufacture of regenerated cellulose mouldings, in which the cellulose is brought into solution without chemical modification. The fibres and filaments obtained from these solutions are grouped under the designation "Lyocell". Especially well-suited organic solvents are tertiary aminoxides, in particular N-methylmorpholin-N-oxide (NMMO). A process for the formation of a cellulose solution in aqueous NMMO is known from DE-A 44 41 468. The manufacture of cellulose mouldings from these solutions is described in EP-A 0 574 870.

In this solution the dissolved cellulose and the solvents, under the thermal conditions of a chemical decomposition, leads to discolourations of the spinning solution. Despite intensive washing of the cellulose mouldings formed, colouring substances remain in the mouldings, as a result of which the degree of whiteness is impaired. In order to reduce the decomposition referred to, a stabilizer is therefore added to the spinning solution. Suitable stabilizers are known from EP-A 0 047 929 and DD 218 104.

The principle is known from WO 97/23666 that the use of TCF-bleached cellulose pulp in the Lyocell process leads to mouldings with a higher degree of whiteness than the use of an ECF-bleached cellulose pulp. Both cellulose pulps are manufactured with similar high initial degrees of whiteness of about 90% and high degrees of purity, in particular with regard to the lignin content. It therefore seems questionable whether the TCF-cellulose pulp in general produces better degrees of whiteness of the cellulose mouldings manufactured from this cellulose pulp than an ECF-cellulose pulp.

DESCRIPTION OF THE INVENTION

The objective on which the present invention is based is the creation of a process for the manufacture of cellulose mouldings with low cellulose decomposition, based on TCF or ECF-bleached cellulose pulp. The reduction in the cellulose decomposition is intended to be attained essentially without special measures in the lyocell process. Additional advantages of the invention are derived from the following description.

The degrees of whiteness of cellulose pulp and fibre of a number of different cellulose pulp provenances were determined, which were either ECF or TCF-bleached. The determination of the degree of whiteness of the cellulose pulp was carried out in accordance with DIN 53145, Part 2. The determination of the degree of whiteness of the fibres was effected in accordance with the method described in WO 97/23666, page 6. The average degree of polymerisation of the cellulose pulps according to the Cuoxam method amounted to about 550 The degrees of whiteness measured at the fibre are compiled in Table 1.

TABLE 1

| Degree of whiteness/ cellulose pulp quality | Manufacturing process | Initial degree of whiteness in cellulose pulp | Degree of whiteness of the spun fibre |
|---|---|---|---|
| Cellunler F Messrs. Rayonier USA | ECF (Elementary Chloride-Free) | 89.9 | 55.0 |
| Temfilm Example 1 Messrs. Tembec Canada | TCF (Total Chloride-Free) | 87.5 | 55.3 |
| ALICELL Messrs. Western Pulp USA | ECF | 88.2 | 58.6 |
| MoDo MoDo Paper | TCF | 93.7 | 58.4 |
| Temfilm Messrs. Tembec Canada | TCF | 89.2 | 58.6 |

It can be seen from Table 1 that with ECE and TCE-bleached cellulose pulps of different provenances the degree of whiteness lies in a narrow range between 87.5 and 93.7. The degree of whiteness. The degrees of whiteness of the spun fibres is likewise in a close range, between 55.0 and 58.6. A higher degree of whiteness of the fibres spun from TCF-bleached cellulose pulp was not perceptible.

Our researches have now revealed that the cellulose decomposition in the course of the Lyocell process, i.e. essentially from the formation through to the coagulation of the spinning solution, depends on the carboxyl group content of the bleached cellulose pulp used to form the spinning solution. In this situation it has been shown that the cellulose decomposition of the spun fibres is less, the lower the carboxyl group content is of the cellulose pulp used to form the solution. It is therefore possible, according to the Lyocell process, to create cellulose fibres with reduced cellulose decomposition by making use of a TCF or ECF-bleached cellulose pulp with low carboxyl group content for the formation of the spinning solution.

The objective referred to above is therefore resolved with the process referred to in the preamble in that, in order to reduce the cellulose decomposition in the process, a TCF-bleached cellulose pulp is used with a carboxyl group content in the range from 1 to 35 μmol/g or an ECF-bleached cellulose pulp with a carboxyl group content in the range from 1 to 50 μmol/g. It has also been shown that the cellulose decomposition is the more restrained in the course of manufacture and processing of the extrusion solution, the lower the carboxyl group content is of the cellulose pulp used. In order to achieve low decomposition of the cellulose and the aminoxide in the Lyocell process, TCF and ECF-bleached cellulose pulps are used in the manufacture of the spinning solution of which the carboxyl group content lies within the range indicated. Cellulose pulps with the carboxyl group contents referred to can be manufactured by a number of different cellulose pulp manufacturers. As a result of the reduced decomposition of the spinning solution components, fewer coloured constituents are also derived, with the result that, as a secondary effect, the degree of whiteness of the moulding formed is also improved.

For preference a TCF-bleached cellulose pulp is used in the dissolving stage with a carboxyl group content in the range from 15 to 30 μmol/g or an ECF-bleached cellulose pulp with a carboxyl group content in the range from 25 to 35 μmol/g. The determination of the carboxyl group content of the celluloses which are to be used can be effected according to Döring; see K. Goetze, Chemical Fibres according to the Viscous Process, Vol. 2, 1997 Edition, p. 1079.

The tertiary aminoxide used as the solvent in the preferred process of the invention is N-methylmorpholin-N-oxide-monohydrate (NMMO—MH).

In a further embodiment of the invention, a cellulose solution with a content of alkalis or organic compounds can be formed, whereby the latter contain at least four carbon atoms, at least two conjugated double bonds, and at least two substitutes —X—H, whereby X has the significance of O or NR, and R can be hydrogen or an alkyl group with 1 to 4 carbon atoms. By means of these solution additives, the low decomposition achieved according to the invention can be reduced still further. The quantity of the organic compound can lie in the range from 0.01 to 0.5% by weight, related to the quantity of the solvent. Suitable organic compounds are known from EP-A-0 047 929. A frequently used compound is isopropyl gallate.

By means of the process according to the invention, the decomposition of the cellulose is restricted to a fraction in the range from 3 to 20% by weight related to the cellulose pulp used. For preference the decomposed cellulose fraction lies in the range from 8 to 1.5% by weight.

The invention further relates to the use of a TCF-bleached cellulose pulp or an ECF-bleached cellulose pulp with a carboxyl group content in the range from 1 to 35 μmol/g or 1 to 50 μmol/g respectively for the formation of a cellulose solution in a solvent containing tertiary aminoxide for the manufacture of mouldings according to the Lyocell process. By means of the use of these cellulose pulps, not only is the decomposition in the course of the Lyocell process reduced, but the degree of whiteness of the mouldings formed is increased.

The invention is now explained in greater detail by the following examples.

EXAMPLES 1 to 6

Long-fibre sulphite cellulose pulp was bleached by alkaline peroxide-reinforced oxygen extracts, then bleached in a known manner with ozone and with peroxide. The bleaching methods are described, for example, in R. P. Singh, The Bleaching of Pulp, TAPPI Press, Atlanta, USA. In this situation, three different carboxyl group contents are used (Examples 1 to 5). Three further samples of the cellulose pulp were bleached with hypochlorite. The degree of polymerisation and the initial degree of whiteness of the pulps were determined in accordance with the methods referred to above, as were the carboxyl group and carbonyl group contents of the cellulose pulp. From the bleached cellulose pulps, spinning solutions with 13% cellulose, 10.5% water and 76.5% NMMO are manufactured in a known manner. The solutions were spun in accordance with the dry-wet process at 95° C. with a nozzle of 65 μm hole diameter. The degree of polymerisation and the degree of whiteness of the fibres obtained were determined. The determination of the degree of polymerisation was effected in accordance with the Cuoxam method. The values obtained are indicated in Table 2.

TABLE 2

| Example<br>Bleaching | 1<br>TCF | 2<br>TCF | 3<br>TCF | 4<br>ECF | 5<br>ECF | 6<br>ECF |
|---|---|---|---|---|---|---|
| Carboxyl group content μmol/g | 20.2 | 24.9 | 34.8 | 31.1 | 35.1 | 41.2 |
| Carboxyl group content*) μmol/g | 52.1 | 48.2 | 35.6 | 26.1 | 24.5 | 82.2 |
| DP cellulose pulp | 540 | 547 | 560 | 555 | 566 | 550 |
| DO fibre | 519 | 505 | 470 | 485 | 465 | 440 |
| DP decomposition % | 3.9 | 7.7 | 16.1 | 12.6 | 16.8 | 20.0 |
| Initial degree of whiteness of cellulose pulp | 93.2 | 93.6 | 93.7 | 93.4 | 93.1 | 93.0 |
| Degree of whiteness of fibre | 68.9 | 65.4 | 58.4 | 62.8 | 58.5 | 56.7 |

*)For determination see K. Goetze, op. cit.

It can be seen from Table 2 that, as the carboxyl group content of the TCF-bleached cellulose pulp and of the ECF-bleached cellulose pulp increases, a substantial drop is to be observed in the degree of polymerisation and of the degree of whiteness of the fibre cellulose. For a given bleached cellulose pulp, the adjustment of the carboxyl group content accordingly opens up the possibility of improving the textile-physical properties of the spun fibre by way of the degree of polymerisation. Due to the reduced colour body formation in the course of the process, a slow discolouration of the spinning bath sets in, as a result of which costs advantages are derived in the regeneration of the solvent media.

EXAMPLES 7 to 10

The degree of polymerisation, the carboxyl group content, the carbonyl group content, and the initial degree of whiteness were determined from four bleached dissolving cellulose pulps. From the cellulose pulps, four spinning solutions were manufactured with 13% cellulose, 10.5% water, and 76.5% NMMO. The zero shear viscosity of the spinning masses at 85° C. was measured (Haake RS 75, year of manufacture 1998). The spinning solutions were spun at 95° C. with a nozzle of 65 μm hole diameter in accordance with the usual dry-wet process. The degree of polymerisation of the celluloses was determined in the spinning solution, and the degree of whiteness of the fibres. The results are compiled in Table 3.

TABLE 3

| Example<br>Provenance/ parameters<br>Bleaching | 7<br>Tembec Temfilm<br>TCF | 8<br>MoDo Paper<br>TCF | 9<br>Tembec TemSpr<br>ECF | 10<br>Rayonier Cellunler<br>ECF |
|---|---|---|---|---|
| Zero shear viscosity | 6967 | 4588 | 4730 | 4720 |
| DP cellulose pulp | 538 | 510 | 520 | 510 |
| DP spinning solution | 490 | 455 | 452 | 450 |
| DP decomposition [%] | 9.9 | 10.8 | 13.1 | 11.7 |
| Carboxyl group content [μmol/g] | 20.9 | 24.4 | 36.8 | 28.8 |
| Carbonyl group content [μmol/g] | 51.3 | 48.2 | 24.6 | 24.3 |
| Initial degree of whiteness | 90.5 | 92.1 | 91.1 | 92.1 |
| Degree of whiteness of fibre | 62.3 | 61.2 | 58.3 | 58.0 |

The values from Table 3 also show that, as the carboxyl group content increases of the cellulose pulp used, the decomposition of the cellulose increases and the degree of whiteness of the fibre deteriorates in relation to the initial degree of whiteness.

The invention claimed is:

1. A process for manufacture of cellulose mouldings with reduced cellulose decomposition from Total Chloride-Free (TCF) bleached or Elementary Chloride-Free (ECF) bleached cellulose, comprising:

dissolving a bleached cellulose pulp having a reduced number of carboxyl groups in an aqueous tertiary aminoxide to form a bleached cellulose solution, wherein the reduced number of carboxyl groups causes reduced decomposition of the bleached cellulose in the process, and wherein the bleached cellulose is selected from the group consisting of: TCF-bleached cellulose comprising a carboxyl group content in the range from 1 to 35 mmol/g and ECF-bleached cellulose comprising a carboxyl group content in the range from 1 to 50 mmol/g;

deforming the cellulose solution; and coagulating the deformed solution to generate a spinning solution for forming the cellulose moulding.

2. The process according to claim 1, wherein the TCF-bleached cellulose comprises a carboxyl group content in the range from 15 to 30 umol/g.

3. The process according to claim 1, wherein the ECF-bleached cellulose comprises a carboxyl group content in the range from 25 to 35 umol/g.

4. The process according to claim 1, wherein of N-methylmorpholin-N-oxide is used as the tertiary aminoxide.

5. The process according to claim 1, further comprising introducing into the bleached cellulose solution at least one organic compound comprising at least four carbon atoms, at least two conjugated double bonds, and at least two substitutes —X—H, whereby X has the significance of O or NR, and R is hydrogen or an alkyl group with 1 to 4 carbon atoms.

6. The process according to claim 5, wherein the organic compound is isopropyl gallate.

7. The process according to claim 1 wherein the decomposition of the cellulose is restricted to a fraction in the range from 3 to 20% by weight, related to the cellulose pulp used.

8. The process according to claim 1, wherein the cellulose mouldings include a member selected from the group consisting of: fibres, filaments, and films.

9. The process according to claim 1, wherein the cellulose mouldings formed from the bleached cellulose pulp having a lower content of carboxyl groups has a higher degree of whiteness relative to cellulose pulp having a higher content of carboxyl groups.

10. The process according to claim 1, wherein the decomposition of the cellulose is restricted to a fraction in the range from 8 to 15% by weight, related to the cellulose pulp used.

11. The process according to claim 1, wherein the cellulose solution comprises about 13% cellulose, about 10.5% water and about 76.5% of NMMO.

12. The process according to claim 1, wherein the cellulose mouldings formed from the bleached cellulose pulp having a lower content of carboxyl groups has a higher degree of polymerization relative to bleached cellulose pulp having a higher content of carboxyl groups.

13. The process according to claim 1, wherein the bleached cellulose pulp having a lower content of carboxyl groups has a lower degree of decomposition relative to bleached cellulose pulp having a higher content of carboxyl groups.

14. A cellulose solution for the manufacture of mouldings comprising a TCF-bleach cellulose having a carboxyl group content in the range from 1 to 35 μmol/g dissolved in a solvent containing a tertiary aminoxide.

15. A cellulose moulding article formed from a TCF-bleached cellulose according to claim 14.

16. A cellulose solution for the manufacture of mouldings comprising a ECF-bleached cellulose having a carboxyl group content in the range of 1 to 50 μmol/g dissolved in a solvent containing a tertiary aminoxide.

17. A cellulose moulding article formed from a TCF-bleached cellulose according to claim 16.

* * * * *